United States Patent [19]

Morgan

[11] Patent Number: 4,660,485

[45] Date of Patent: Apr. 28, 1987

[54] ROTATING NEEDLE GUARD

[75] Inventor: Francis Morgan, Bridgewater, N.J.

[73] Assignee: SSMC Inc., Stamford, Conn.

[21] Appl. No.: 204,425

[22] Filed: Nov. 6, 1980

[51] Int. Cl.[4] ..... D05B 3/02; D05B 55/06

[52] U.S. Cl. ..... 112/467; 112/227

[58] Field of Search ..... 112/109, 111, 158 R, 112/227, 228, 230, 467

[56] References Cited

U.S. PATENT DOCUMENTS

| | | | |
|---|---|---|---|
| 420,847 | 2/1890 | Wheeler | 112/228 |
| 523,333 | 7/1894 | Diehl | 112/228 |
| 1,155,120 | 9/1915 | Allen | 112/228 |
| 1,999,251 | 4/1935 | Moranville | 112/227 |
| 2,074,849 | 3/1937 | MacBride | 112/158 R |
| 2,218,556 | 10/1940 | Rubel | 112/261 |
| 3,023,721 | 3/1962 | Johnson | 112/227 X |
| 3,120,204 | 2/1964 | Ketterer | 112/228 |

FOREIGN PATENT DOCUMENTS

| | | |
|---|---|---|
| 54-30561 | 2/1979 | Japan . |
| 54-175956 | 12/1979 | Japan . |
| 55-107882 | 7/1980 | Japan . |

*Primary Examiner*—W. Carter Reynolds

*Attorney, Agent, or Firm*—Robert E. Smith

[57] ABSTRACT

A needle guard for an industrial zigzag sewing machine designed to provide support for the sewing needle in all lateral positions of the needle. The needle guard provides a lead in surface to return an already deflected needle to a supporting surface which in a first embodiment lies in a plane immediately adjacent a plane including the circular path traversed by the loop seizing beak. In a second embodiment a supporting surface is provided which compensates for the point of contact variations due to the cone pointed end of the sewing needle.

1 Claim, 14 Drawing Figures

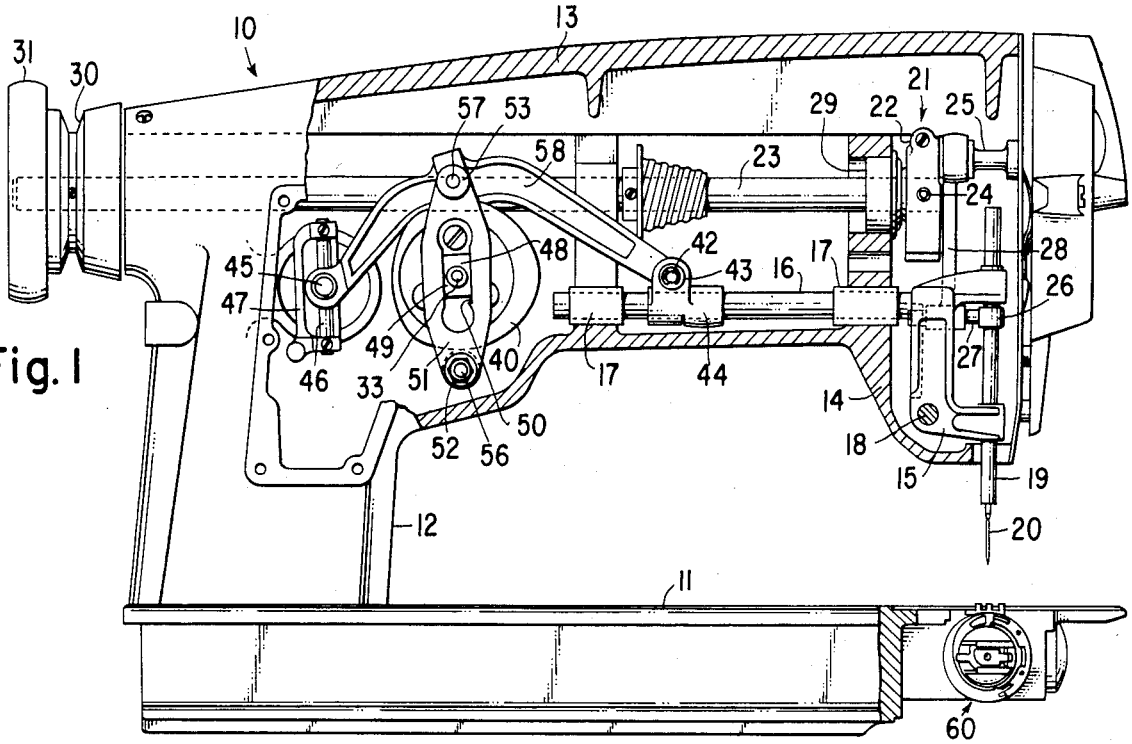
Fig. 1
Fig. 2
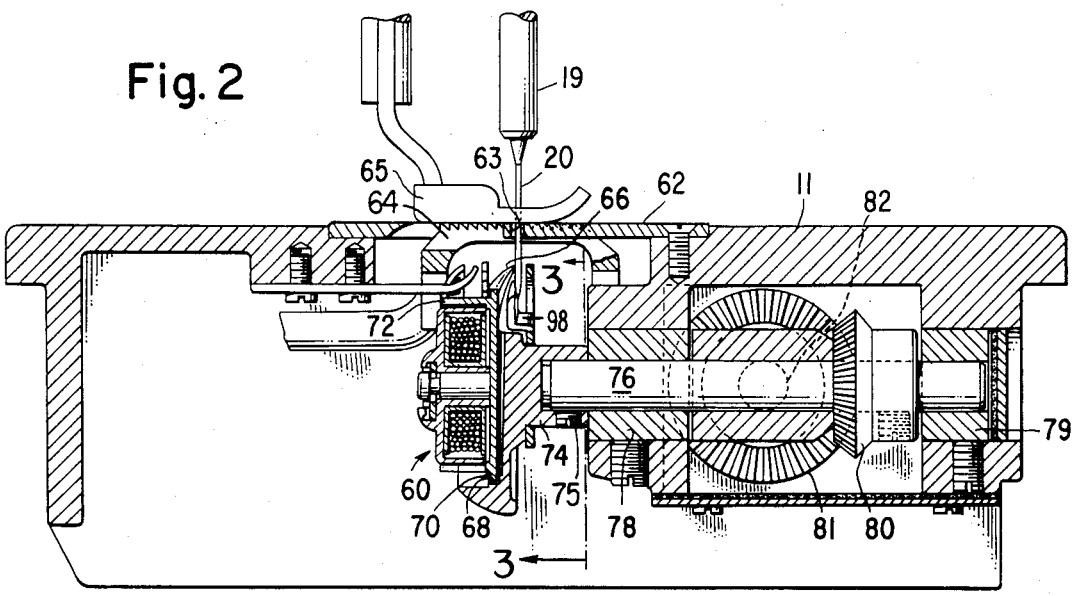

Fig. 3
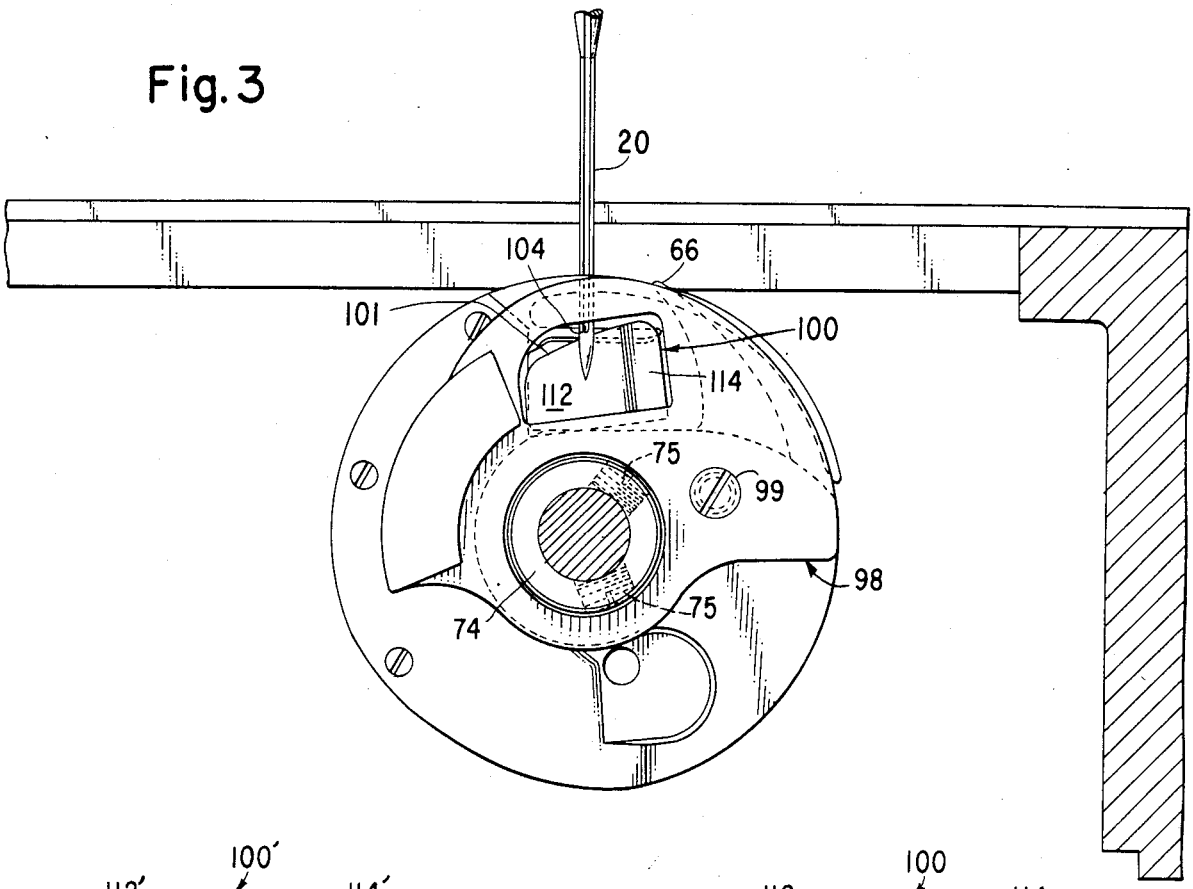
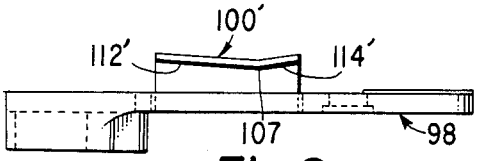
Fig. 8
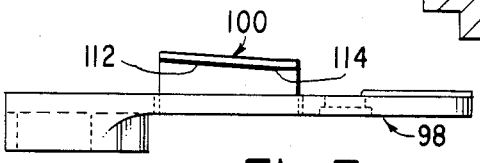
Fig. 7
Fig. 9
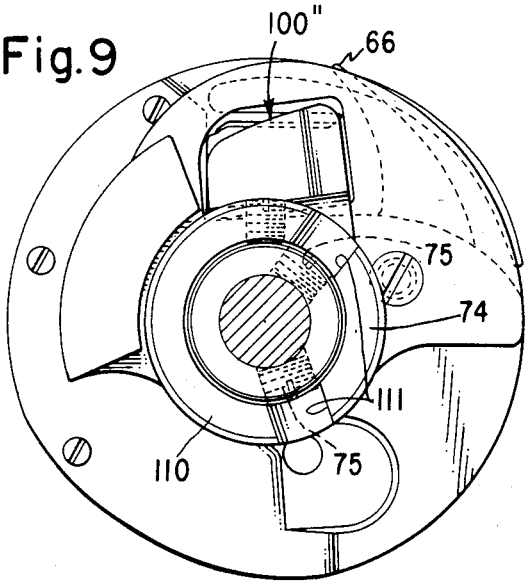
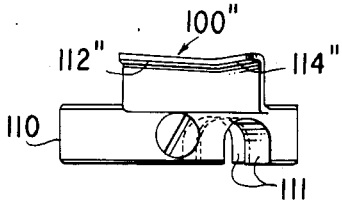
Fig. 10
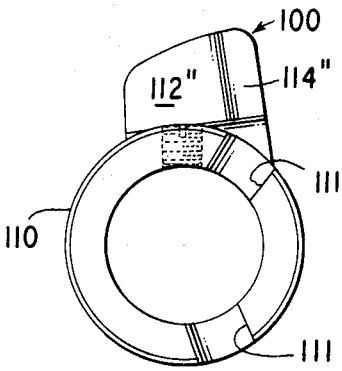
Fig. 11

ROTATING NEEDLE GUARD

BACKGROUND OF THE INVENTION

This invention is in the field of sewing machines; more particularly, it is concerned with a needle guard for an industrial lockstitch sewing machine with a rotating looptaker and having the capability for implementing a zigzag stitch.

In sewing machines, it frequently becomes necessary to provide for a needle guard to prevent the looptaker beak from harpooning the sewing needle because of, for example, an operator tugging upon the work material causing the needle to deflect into the path of the looptaker beak. Such hazards are obviated by utilizing a needle guard which prevents movement of the sewing needle towards the looptaker beak. In practice, the needle guard may be fixed with respect to the looptaker beak as is shown in the U.S. Pat. No. 1,155,120, issued on Sept. 28, 1915 to E. B. Allen. In that patent, it is disclosed to provide a needle guard which is part of the rotary looptaker, and which acts to protect the loop seizing beak of the looptaker from contacting the thread carrying needle at substantially the time when the latter is presenting its loop of needle thread to the action of the looptaker. The free edge of the guard in that patent is arranged with respect to the periphery of the looptaker so that during the time the guard is in a position to protect the needle the edge will maintain the uniform relationship with respect to the needle eye during the time that the guard is passing the needle. Alternatively there is the type of needle guard arranged to operate transversely of the line of feed so that an operator tugging upon the work material to advance or retard the feed of work material therethrough will not be successful to deflect the sewing needle into the path of the looptaker beak. Such an arrangement is shown in the Singer 457 Machine in which the needle guard is fashioned at an angle so as to permit a needle already deflected to be led into a position where the looptaker beak may enter a loop of thread immediately behind the sewing needle, without striking the sewing needle. In practice, the needle guard in the 457 Machine is set to a position where it touches a sewing needle without deflecting it while the looptaker beak passes immediately adjacent the needle without touching it. However, in zigzag sewing, particularly for a wide bight zigzag, this adjustment may be made at right needle position and there may be a substantial gap, of approximately, 0.010", between the needle guard and the needle at left needle position due to the lead in angle of the needle guard and vertical displacement of conical pointed portion of the needle in relation to the needle guard surface. In the past it has been possible to provide an improved looptaker having a cobalt tipped beak which would not be blunted by a collision with the sewing needle. However, these special looptakers represent a considerable increase in cost over the usual looptaker, as much as twice the cost thereof.

What is required is some means for protecting the looptaker beak at all positions of the sewing needle, right or left, without the need for resorting to a special and expensive looptaker.

SUMMARY OF THE INVENTION

The needle guard is fashioned with a lead in portion to insure that the sewing needle will be taken from a deflected position where it could be harpooned by the looptaker beak to its normal position immediately adjacent the looptaker beak. This lead in portion has been arranged at an angle of approximately 2° from the plane normal to the rotating hook drive shaft. Over the supporting portion of the needle guard during which the looptaker beak would be effective, that is, over that portion of the needle guard when the sewing needle has presented a loop for taking by the looptaker beak, the 2° taper may be merged to a surface which is parallel to a plane normal to the rotating hook drive shaft. A machine setting may be made with a rotating looptaker in the sewing machine to permanently deflect the needle guard to a position where, with the sewing needle in the extreme right needle position, the guard is touching the conical point portion of the sewing needle; and with the needle in the left needle position the guard is spaced only a few thousandths from a location lower down on the cone of the point of the sewing needle.

In an alternative construction, designed to obtain a closer correspondence between the support attainable in the right and the left needle positions, the supporting portion of the surface would be modified to provide a tapering away of the surface from a point which permits contact of a point lower on the cone point portion of the sewing needle in the left needle position, at an angle which permits contact with the sewing needle in the right needle position. In its initial setting, the needle guard may be set to touch the sewing needle in the right needle position and when the sewing needle rises from the left needle position, a location on the cone point lower than that touching in the right needle position will touch a new apex of the needle guard to obtain support therefore in approximately the same manner as in the right needle position.

DESCRIPTION OF THE DRAWINGS

The novel features which are considered as characteristic for the invention are set forth in particular in the appended claim. The invention itself, however, both as to its construction and its method of operation, together with additional objects and advantages thereof will best be understood from the following description of a preferred embodiment when read in conjunction with the accompanying drawings in which:

FIG. 1 is a rear elevational view, partly in section, of a sewing machine showing the zigzag mechanism thereof and the looptaker therein;

FIG. 2 is a front end elevation, partly in section, of a portion of the zigzag sewing machine shown in FIG. 1 in which the present invention has been embodied, the section being taken substantially in the vertical plane containing the rotation axis of the looptaker of the machine;

FIG. 3 is a section taken substantially along line 3—3 of FIG. 2 disclosing the thread guard of the rotating looptaker of the sewing machine shown in FIG. 1;

FIG. 7 is a top plan view of the thread guard and sewing needle shown in FIGS. 4–6 to show the path of the sewing needle through the lead in portion of the thread guard and into the supporting portion thereof;

FIG. 8 is an alternative embodiment of the needle thread guard which is formed to compensate for the reduced thickness of the needle point in the left needle position;

FIG. 9 is a view similar to FIG. 3 disclosing the rotating looptaker with a separable thread guard;

FIG. 10 is a top plan view of the separable thread guard shown in FIG. 9; and, FIG. 11 is a frontal elevation of the separable thread guard of FIG. 10.

Figure 4A:
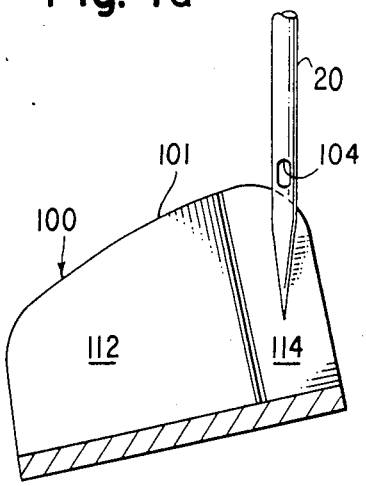
FIGS. 4*a* and *b* are, respectively, frontal and side elevations of the thread guard and sewing needle with the sewing needle in the right needle position.

With reference to the drawings, especially FIG. 1, the invention may be incorporated in a sewing machine 10 having a frame including a work supporting bed 11, a hollow standard 12 rising from one end of the bed, hollow bracket arm 13 at the top of the standard overhanging the bed, and a hollow sewing head 14 at the free end of the bracket arm.

Founded in the sewing head is a needle bar gate 15. The needle bar gate is connected to the end of a slide rod 16 which is mounted in bearings 17 in the bracket arm for lateral oscillation of the needle bar gate. A pair of guide pins 18, of which only one is shown, embrace the side of the needle bar gate permitting lateral oscillation but preventing rotation.

Mounted on the needle bar gate for axial reciprocation is a needle bar 19. A needle 20 is removably connected to the end of the needle bar. Axial reciprocation is imparted to the needle bar 20 through a conventional crank mechanism indicated generally at 21. The crank mechanism includes a crank 22 which is locked to the end of an arm shaft 23 by a roll pin 24. The crank 22 has a crank pin 25 and the needle bar has a clamp 26 which carries a pivot pin 27. A link 28 is pivotally mounted on the crank pin 25 of the crank 22 and the pivot pin 27 of the needle bar 19 to transmit axial reciprocation to the needle bar. The arm shaft 23 is journalled in bearings 29 in the bracket arm 13 and is rotated through a pulley 30 on a handwheel 31 at the standard end of the arm shaft by a conventional v-belt connection to a motor or foot treadle which are not shown. Further particulars on the cam construction for the sewing machine shown in FIG. 1 may be had by reference to the U.S. Pat. No. 3,443,538 issued on May 13, 1969 to the same assignee as the instant application, which patent is hereby incorporated by reference herein.

Utilizing the teachings of the above referenced patent, FIG. 1 discloses a bearing 48 having parallel bearing surface 49 mounted on a cam shaft 33 extending through the sewing machine and supporting thereon a cam 40. A slideway 50 in a bracket 51 slides on the bearing surfaces of the bearing 48. Two cam follower rollers 52 and 53 are journalled on pins 56 and 57 at the ends of the bracket 51 and contact the cam surface of the cam 40.

An arm 58 is pivotally connected to the pin 57 for the uppermost cam follower roller 53. One end of the arm 58 is connected to a pivot pin 42 held between a pair of ears 43 on a clamp 44 on the slide rod 16. The other end of the arm is pivotally connected to a collar 45 which slides on a slideway in the form of a pin 46 held by a frame 47. The frame is adjustable to change the angular and lateral orientations of the pin 66 as described in U.S. Pa. No. 3,313,258. Thus, lateral oscillation of the needle bar 19 and sewing needle 20 is encouraged by the inclination of the frame 47 and the effect of this inclination on the up and down motions of the arm 58 under the urgings of the cam 40.

In the bed 11, there is shown partially in section a view of the looptaker 60 which is shown more particularly in FIGS. 2 and 3. In FIGS. 2 and 3, the bed 11 has secured thereupon a throat plate 62 provided with a slot 63 through which the needle 20 may vertically reciprocate and laterally vibrate. Operating through other slots in the throat plate 62 is a feed dog 64, part of a feed system (not shown) supported within the bed 11 to feed work material thereacross. Opposed to the feed dog 64 is the usual spring depressed presser foot 65.

Operative with the sewing needle 20 in the formation of lockstitches is the rotary looptaker 60 which is of the type having a needle thread loop seizing beak 66. The looptaker 60 is internally provided with a raceway 68 in which is journalled the peripheral bearing rib 70 of a bobbin carrier 72 suitably restrained against rotation with the looptaker. The looptaker 60 has a hub 74 secured by set screws 75 upon one end of a horizontally disposed looptaker shaft 76 extending substantially parallel to the line of feed or, in other words, crosswise of the bed 11. The looptaker shaft 76 is journalled in bearings 78 and 79, and supports behind the looptaker 60 thereof a beveled gear 80 shown in mesh with a second beveled gear 81 which is driven through shaft 82 from the actuating means for the sewing machine.

Figure 5A:
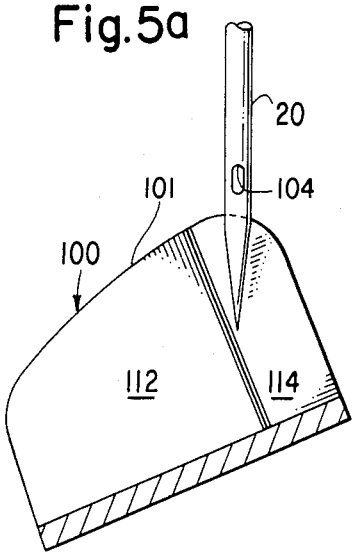
FIGS. 5*a* and *b* are frontal and side elevations of the thread guard and sewing needle with the sewing needle shown in the center needle position.
Figure 6A:
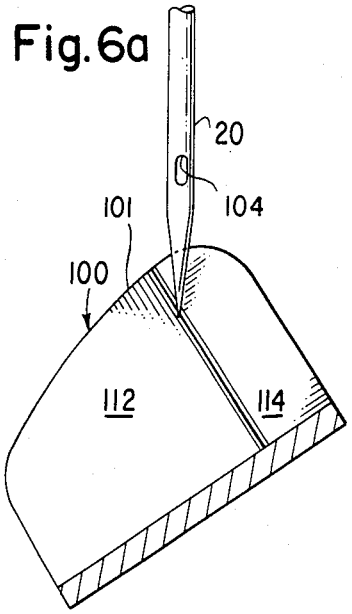
FIGS. 6*a* and *b* are frontal and side elevations of the needle thread guard and sewing needle in the left needle position.
Figure 4B:
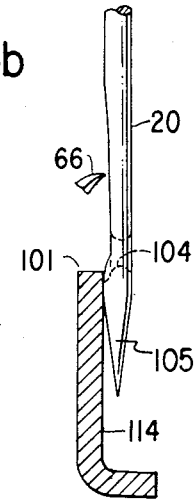
Figure 5B:
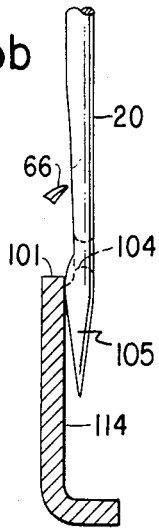
Figure 6B:
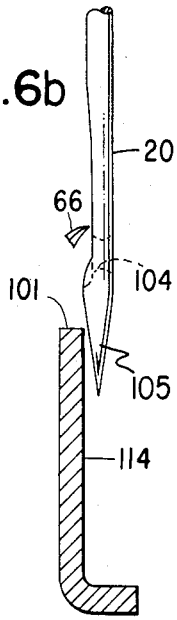

The looptaker 60 includes as part thereof a needle guard assembly 98 which fits closely about the hub 74 of the looptaker and is attached to the base thereof by screw 99 (see FIG. 3). The needle guard assembly 98 includes as part thereof a needle guide 100 which is spaced from the main body of the needle guard and has a lead in portion 112 thereof at a slight angle thereto so as to guide a needle into the proper position with respect to the loop seizing beak 66. According to the invention, the remaining surface of the needle guide 100 consists of a supporting portion 114 whose function is to support the sewing needle 20 against those forces which would tend to pull the needle into the path of the loop seizing beak 66 of the looptaker 60. The periphery 101 of the needle guide 100 is shaped so as to be arranged below the eye 104 of the needle 20 as the sewing needle is elevated from a bottom dead center position to a loop seizing position. In FIG. 4*a*, the eye 104 of the needle 20 isolated just above the periphery 101 of the needled guide 100 when the sewing needle is in the right needle position. In FIG. 5*a* and FIG. 6*a*, respectively, the needle is in the center and left position and the eye 104 of the needle 20 is correspondingly elevated from the periphery 101 of the needle guide 100, due to the increased time it takes the loop seizing beak 66 to come to those needle positions. The needle guide 100 of the needle guard assembly 98 is generally adjusted after installation in a sewing machine from an open position to a position touching the sewing needle 20 in the right needle position. The loop seizing beak 66 would have been positioned by positioning of looptaker 60 through use of set screws 75 through hub 74 thereof, to pass immediately adjacent the sewing needle 20 without touching the sewing needle. Thus, any force exerted on the work material by a sewing machine operator would be ineffective to distort the sewing needle 20 to a position where the loop seizing beak 66 would run into the sewing needle because of the support given by the needle guide 100 thereto. However, where the needle guide 100 is tapered at an approximate angle of 2° to insure that the sewing needle 20 is guided into the proper relationship for loop seizing there is the difficulty that in the left needle position there would be a relatively large gap that would allow the sewing needle 20 to be deflected into a position where the loop seizing beak 66 could strike the sewing needle. In order to obviate this possibility, the needle guide 100 is provided with the supporting surface 114 in the terminal portion thereof which, in a first embodiment, lies in the plane including the top of the loop seizing beak 66 and normal to the axis of rotation of the looptaker 60 to provide support to the sewing needle 20 when in the right, center or left needle positions. In FIG. 5*b*, the sewing needle 20 is shown in the center needle position at a time when the loop seizing beak 66 passes behind the sewing needle 20 and through the loop thrown therebehind. Providing the supporting surface 114, which lies in a plane normal to the axis of rotation of the looptaker 60, thus provides support for the sewing needle 20 in the center needle position. In FIG. 6*b*, the sewing needle 20 is shown in the left needle position where due to the conical point 105 of the needle 20 there exists a slight gap between the needle guide 100 and the needle which will permit a very small motion to take place. Since this motion might, under certain circumstances, present a problem, a profile for the needle guide 100' as is shown in FIG. 8 may be provided where the lead in portion 112' with an angle of approximately 2° closing is still provided and a supporting surface 114' is also provided having an opening angle of approximately the same order of magnitude. The exact dimensions necessary may be calculated by considering the gap between the sewing needle 20 and needle guide 100 in the left needle position for a guide adjusted as described above in the right needle position. With this new needle guide 100' having a new surface 114', the needle guide is set as before by deformation thereof to the point where the guide touches the sewing needle 20 in the right needle position. Because of the geometry of this surface, it will be apparent that the sewing needle 20 in the left needle position will cross at the apex 107 of the supporting surface 114' and the lead in surface 112', thereby bringing the needle guide closer to the needle in the left needle position so as to be able to provide support therefore at any position of the sewing needle (see also Figs. 6*a* and *b*).

In yet another embodiment disclosed in FIGS. 9, 10 and 11, a needle guide 100'' is supported on a hub 110 so that the needle guide may be made adjustable for use with many different sizes of sewing needles. Thus, for example, the needle guide 100'' may be optimally positioned in a single sewing machine for work on extremely fine material utilizing a smaller needle as well as on heavier work material utilizing a larger needle; and provides adequate support for the sewing needle at all lateral needle positions regardless of needle size used without the necessity for resetting the needle guide. Access openings 111 are provided in the hub 110 so as to permit access to set screws 75 for positional adjustment of the looptaker 60.

It will be understood that what has been disclosed herein is a novel needle guide arrangement which finds particular utility when applied to an industrial sewing machine. It will be appreciated that modifications and variations of the above-described invention may become evident to one skilled in the art in light of the above teachings. However, it is to be understood that the present disclosure is for the purpose of illustration only, and should not be construed as a limitation on the scope of the invention. All modifications which do not depart from the spirit of the invention are intended to be included within the scope of the appended claim.

I claim:

1. A zigzag sewing machine comprising a frame including an arm and work supporting bed, a needle bar supported in said arm for endwise reciprocation and lateral oscillation, a sewing needle carried on one end of said needle bar, said sewing needle having a cone shaped end merging from full thickness adjacent a thread carrying eyelet to a point, means for reciprocating and laterally oscillating said needle bar in the formation of zigzag stitches extending between a maximum left needle position and a maximum right needle position, a looptaker supported in said bed for rotation on a horizontal axis substantially perpendicular to the lateral oscillations of said needle bar, said rotating looptaker having a loop seizing beak passing in one position along one side of said sewing needle for cooperation therewith in the formation of stitches, said rotating looptaker further including means thereon for guiding said sewing needle into cooperative engagement with the loop seizing beak and for supporting said sewing needle against deflection into the path of motion of said loop seizing beak in all lateral positions of said sewing needle, said guiding means being implemented by a lead in surface of said rotating looptaker extending from before and beyond said loop seizing beak on said one side of said sewing needle to said loop seizing beak at the one of said maximum, needle positions last arrived at by said loop seizing beak, said supporting means being implemented by a supported surface extending from said one of said maximum needle positions to the other of said maximum needle positions, said supporting surface being contoured with an apex at said one of said maximum needle positions for contacting said cone shaped end of said needle for support thereof, said supporting surface extending after said apex to a plane the extension of which crosses the path of motion of said loop seizing beak for support of said full thickness of said sewing needle adjacent the eyelet thereof in the other of said maximum needle positions.

* * * * *